United States Patent [19]

Zimmerman

[11] Patent Number: 4,616,747

[45] Date of Patent: Oct. 14, 1986

[54] HAIR PIECE STORAGE AND CARRYING CASE

[76] Inventor: Marlin Zimmerman, 807 Williams Charles Ct., Apt. K, Green Bay, Wis. 54304

[21] Appl. No.: 771,501

[22] Filed: Aug. 30, 1985

[51] Int. Cl.[4] ..... A45C 11/02; B65D 25/10; B65D 85/18

[52] U.S. Cl. ..... 206/8; 206/45.19; 223/66; 211/30; 248/176; 248/177

[58] Field of Search ..... 206/8, 9, 45.19; 223/66; 132/54; 211/30; 248/176, 177

[56] References Cited

U.S. PATENT DOCUMENTS

| | | | |
|---|---|---|---|
| 2,466,605 | 4/1949 | Marcus | 206/9 |
| 3,396,832 | 8/1968 | Bloom et al. | 206/8 |
| 3,464,603 | 9/1969 | Hunter | 223/66 |
| 3,552,549 | 1/1971 | Creese et al. | 206/8 |
| 3,621,988 | 11/1971 | Songer et al. | 206/8 |
| 3,628,655 | 12/1971 | Bohannon | 206/8 |
| 3,658,174 | 4/1972 | Friedman | 206/8 |

*Primary Examiner*—William Price

*Assistant Examiner*—Sue A. Weaver

*Attorney, Agent, or Firm*—Andrus, Sceales, Starke & Sawall

[57] ABSTRACT

A hairpiece storage and carrying case includes a divider for partitioning the hollow interior of the case into a hairpiece receiving compartment and an implement receiving compartment. A frame member in the shape of a human skull is disposed in the hairpiece compartment for supporting a hairpiece so that the front portion of the hairpiece is positioned between the frame member and the divider, and the rear and side portions of the hairpiece are disposed between the frame member and the side walls of the carrying case. A landing interconnects the frame member and the divider and defines a support surface in spaced relationship from the bottom wall of the case to support the front portion of the hairpiece at a desired height above the ends of sides and rear of the hairpiece to maintain the hairpiece in a simulated natural style of arranging hair. Preferably, the divider, frame member and landing are constructed as a one-piece plastic unit adhesively mounted within the interior of the case.

5 Claims, 4 Drawing Figures

HAIR PIECE STORAGE AND CARRYING CASE

BACKGROUND OF THE INVENTION

The present invention relates to storage and carrying cases, and more particularly to a hairpiece storage and carrying case.

A hairpiece worn by a man or woman must be properly cared for in order to maintain its natural appearance. Although typically such care includes grooming and cleaning the hairpiece, it is also important to properly store the hairpiece when not being worn. In the past, storage and carrying cases for hairpieces have merely provided a compartment in which the hairpiece is placed, or if a spherical head-like frame is provided to support the hairpiece, the front, rear and side portions of the hairpiece have been allowed to merely hang freely. Neither arrangement is conducive to maintaining the hairpiece while in storage in a simulated natural style as worn by a user. For example, men typically have the front portion or bangs of the hairpiece combed or brushed backwardly off the forehead. However, if the front portion of the hairpiece is allowed to hang freely in the case or is merely placed within a compartment in the case the front portion of the hairpiece tends to "set" in a downwardly hanging position such that it is difficult to comb or brush the front portion of the hairpiece rearwardly off a user's forehead.

It is therefore desirable to provide a storage and carrying case which will maintain a hairpiece in a simulated natural style of arranging hair.

SUMMARY OF THE INVENTION

A hairpiece storage and carrying case includes a divider for partitioning the hollow interior of the case into a hairpiece receiving compartment and an implement receiving compartment. A frame member in the shape of a human skull is disposed in the hairpiece compartment for supporting a hairpiece so that the front portion of the hairpiece is positioned between the frame member and the divider, and the rear and side portions of the hairpiece are disposed between the frame member and the side walls of the carrying case. A landing interconnects the frame member and the divider and defines a support surface in spaced relationship from the bottom wall of the case to support the front portion of the hairpiece at a desired height above the sides and rear of the hairpiece to maintain the hairpiece in a simulated natural style of arranging hair.

The landing includes a top wall extending between the frame member and the divider spaced from the bottom wall of the case to define the support surface, and a pair of opposite side walls extending between the frame member and the divider and between the top wall of the landing and the bottom wall of the case. Preferably, the side walls of the landing extend in a divergent manner from the frame member to the divider so that only the front portion or bangs of the hairpiece is held at a height above that of the sides and rear of the hairpiece to maintain a "brushed back" natural style.

The divider, frame member and landing are preferably constructed as a one-piece plastic unit which is molded to have a flange disposed around its periphery which is adapted to mate with the bottom wall of the case. Mounting means such as an adhesive is utilized to mount the unit in the case.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
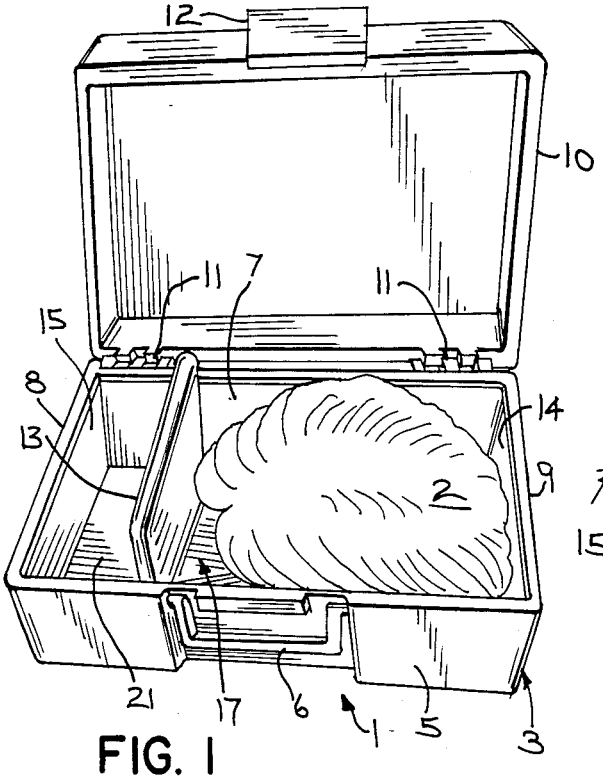
FIG. 1 is a front perspective view illustrating a hair piece storage and carrying case constructed in accordance with the principles of the present invention.
Figure 2:
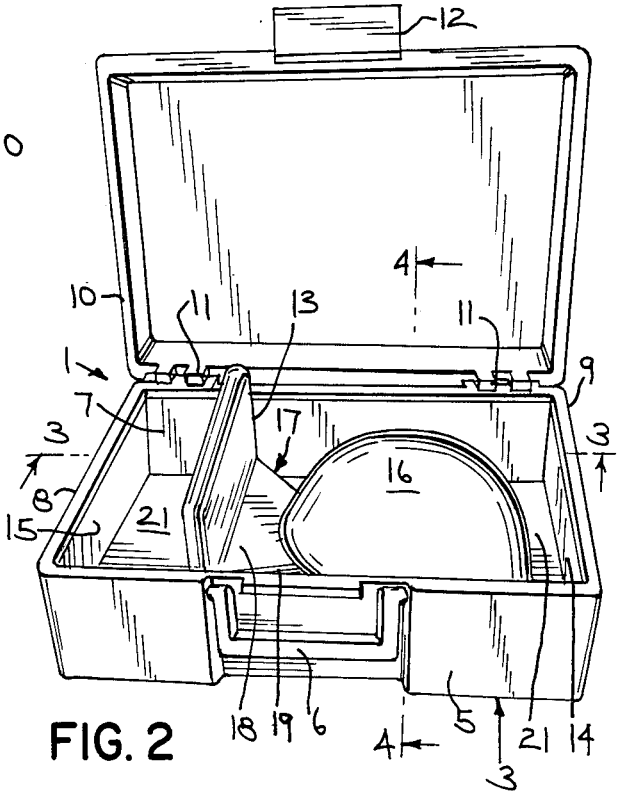
FIG. 2 is a front perspective view similar to FIG. 1 with the hairpiece removed to show the interior of the case.

Referring now to the drawings, FIGS. 1 and 2 illustrate a storage and carrying case, generally designated by the numeral 1, for a man's hairpiece 2. Case 1 is preferably composed of a plastic material and includes a housing 3 having a flat bottom wall 4 and four upright side walls extending therefrom to form a hollow interior for housing 3. The housing sidewalls include a front wall 5 on which a carrying handle 6 is pivotally mounted, a rear wall 7 and a pair of opposite end walls 8 and 9 interconnecting walls 5 and 7. A lid or cover 10 is pivotally connected to the top of rear wall 7 by a pair of hinges 11 and may be closed by a latch 12 which locks lid 10 to front wall 5. It should be noted that although case 1 is illustrated as rectangular in shape it may also be formed in any other conventional configuration such as square or circular.

Figure 3:
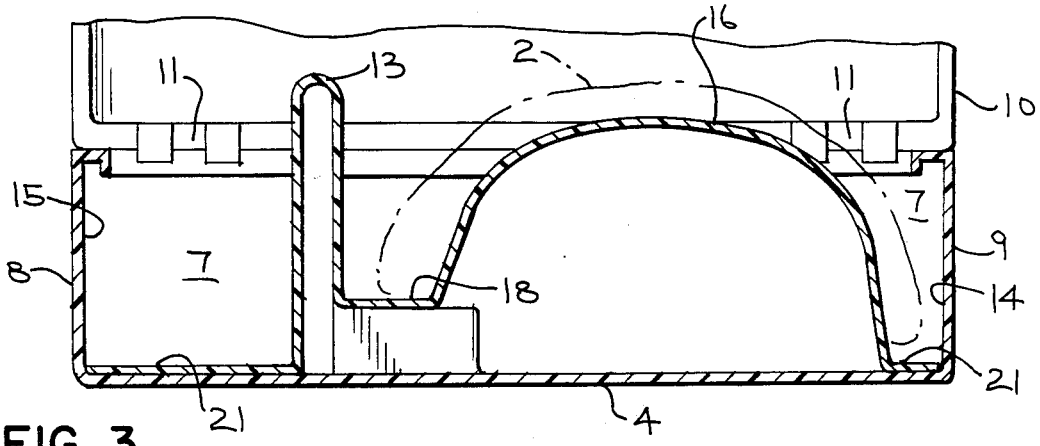
FIG. 3 is a cross sectional view taken along the plane of the line 3—3 in FIG. 2.
Figure 4:
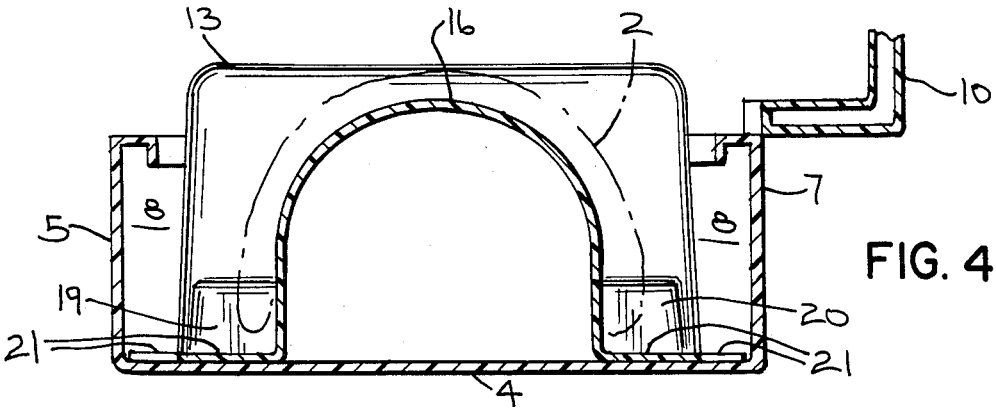
FIG. 4 is a cross-sectional view taken along the plane of the line 4—4 in FIG. 2.

As best seen in FIGS. 2–4, case 1 includes a divider 13 for partitioning the hollow interior of housing 3 into a hairpiece receiving compartment 14 and an implement receiving compartment 15. Compartment 15 may be utilized for storing such articles as a comb, brush, tape for holding hairpiece 2 on a user's head, scissors and the like. Divider 13 extends substantially between front wall 5 and rear wall 7, and has a height slightly greater than the height of walls 5 and 7 to extend between lid 10 and bottom wall 4 so as to prevent the implements within compartment 15 from gaining access to compartment 14 when case 1 is carried, tipped or tilted with cover 10 closed. This prevents the implements in compartment 15 from damaging hairpiece 2.

In contrast to compartment 15, compartment 14 is utilized to store and carry hairpiece 2. In order to accomplish this, a frame member 16 is disposed in compartment 14. Frame member 16 is hemispherically shaped and dimensioned to substantially conform to the shape of a human skull so that proper support for hairpiece 2 is provided. It should be noted that frame member 16 is spaced from rear wall 7, end wall 9, front wall 5 and divider 13. Thus, as shown best in FIGS. 3 and 4, the front or bangs portion of hairpiece 2 is disposed between frame member 16 and divider 13, and the rear and side portions of side piece 2 are disposed between frame member 16 and walls 7, 9, and 5. Thus, the rear and side portions of side piece 2 are permitted to hang in a natural manner as they would hang when being worn by a user. Double-sided tape applied to the inside of hairpiece 2 secures hairpiece 2 on the surface of frame member 16 so that when carrier hairpiece 2 does not slide on frame member 16.

As shown best in FIGS. 2 and 3, a landing 17 interconnects frame member 16 and divider 13. Landing 17 includes a top wall 18 extending between frame member 16 and divider 13 which is spaced from bottom wall 4 of housing 3 that defines a support surface which supports the front or bangs portion of hairpiece 2 at a desired height above that of the ends of the sides and rear of hairpiece 2. This maintains the front or bangs portion of hairpiece 2 in a simulated "swept back" natural style of arranging a man's hair, and prevents the front or bangs portion of hairpiece 2 from becoming "set" in a downwardly hanging manner. Landing 17 also includes a pair of opposite side walls 19 and 20 extending between frame member 16 and divider 13 and between top wall 18 and bottom wall 4 of housing 3. As seen best in FIGS. 2 and 4, side walls 19 and 20 of landing 17 extend in a divergent manner from frame member 16 to divider 13. This insures that only the front or bangs portion of hairpiece 2 is held at a height above the ends of the side and rear portions of hairpiece 2.

As seen best in FIGS. 3 and 4, divider 13, frame member 16 and landing 17 are constructed as a one-piece molded plastic unit having a flange 21 extending around its periphery which is adapted to mate with bottom wall 4 of housing 3. Mounting means such as an adhesive of any conventional type may be utilized to mount flange 21 to bottom wall 4 of housing 3. The use of a one piece molded plastic unit allows for ease of manufacture and permits the unit to be readily adapted to different sized frame members for different sized hairpieces. Also, the one-piece unit enables the divider 13, frame member 16 and landing 17 to be readily adaptable to different sizes and shapes of case 1.

Various modes of carrying out the invention are contemplated as being within the scope of the following claims particularly pointing out and distinctly claiming the subject matter which is regarded as the invention.

I claim:

1. A hairpiece storage and carrying case, comprising:

a housing having a bottom wall, a plurality of upright side walls and a lid defining a hollow interior;

a divider for partitioning said hollow interior into a hairpiece-receiving compartment and an implement-receiving compartment;

a frame member disposed in said hairpiece-receiving compartment dimensioned to substantially conform to the shape of a human skull for supporting a hairpiece having front, rear and side portions thereon so that said front portion of said hairpiece is disposed between said frame member and said divider and said rear and side portions of said hairpiece are disposed between side frame member and said side walls; and a landing interconnecting said frame member and said divider and defining a support surface in spaced relationship from said bottom wall to support the front portion of the hairpiece at a desired height above that of the sides and rear of the hairpiece to maintain the hairpiece in a simulated natural style of arranging hair.

2. The case of claim 1, wherein said landing includes a top wall extending between said frame member and said divider spaced from the bottom wall of said housing that defines said support surface, and a pair of opposite side walls extending between said frame member and said divider and between said top wall and the bottom wall of said housing.

3. The case of claim 2, wherein the side walls of said landing extending in a divergent manner from said frame member to said divider.

4. The case of claim 1, wherein said divider, frame member and landing are constructed as a one-piece plastic unit having a flange at its periphery adapted to mate with the bottom wall of said housing, and further including means for mounting said flange to said housing.

5. The case of claim 4, wherein said mounting means comprises an adhesive.

* * * * *